US007453424B2

(12) United States Patent
Johnson et al.

(10) Patent No.: US 7,453,424 B2
(45) Date of Patent: Nov. 18, 2008

(54) MATRIX DISPLAY DEVICE WITH PHOTOSENSITIVE ELEMENT

(75) Inventors: Mark Thomas Johnson, Eindhoven (NL); Andrea Giraldo, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 616 days.

(21) Appl. No.: 10/528,493

(22) PCT Filed: Aug. 8, 2003

(86) PCT No.: PCT/IB03/03599

§ 371 (c)(1),
(2), (4) Date: Mar. 18, 2005

(87) PCT Pub. No.: WO2004/027744

PCT Pub. Date: Apr. 1, 2004

(65) Prior Publication Data

US 2006/0038751 A1 Feb. 23, 2006

(30) Foreign Application Priority Data

Sep. 23, 2002 (EP) ..... 02078935

(51) Int. Cl.
*G09G 3/30* (2006.01)

(52) U.S. Cl. ..... 345/76; 345/82; 345/84

(58) Field of Classification Search ..... 345/76, 345/82, 84

See application file for complete search history.

(56) References Cited

U.S. PATENT DOCUMENTS 6,373,455 B1 * 4/2002 Kuribayashi et al. ..... 345/76
6,489,631 B2 * 12/2002 Young et al. ..... 257/59
2001/0052597 A1 * 12/2001 Young et al. ..... 257/59
2002/0047817 A1 * 4/2002 Tam ..... 345/76
2002/0190934 A1 * 12/2002 Yoshida et al. ..... 345/76

FOREIGN PATENT DOCUMENTS

WO WO0120591 A1 3/2001
WO WO 01/99190 A2 12/2001

* cited by examiner

*Primary Examiner*—Bipin Shalwala
*Assistant Examiner*—Afroza Y Chowdhury
(74) *Attorney, Agent, or Firm*—Michael E. Belk

(57) ABSTRACT

A matrix display device comprises an array of addressable pixels (10) each having a display element (20) and a control circuit for controlling the operation of the display element. The control circuit includes a charge storage capacitor (36) and a photosensitive device (40) coupled to the storage capacitor for regulating charge stored on the storage capacitor (36) in accordance with light falling on the photosensitive device (40). The control circuit further comprises means for independent voltage control (42) of a gate terminal of the photosensitive device (40), preferably a phototransistor. In this way a more efficient and flexible biasing of the phototransistor is possible. The means preferably comprise a second row line (42) being connected to the gate terminal of the photosensitive device (40). This additional line allows also the use of transistors of the same polarity for this type of pixel circuit, saving additional process masks (and costs). In addition, it becomes possible to use the phototransistor as a TFT switch. This dual function (phototransistor/TFT switch) enables the pixel circuit to provide additional features; for example duty-cycle techniques for motion blur compensation.

12 Claims, 6 Drawing Sheets

MATRIX DISPLAY DEVICE WITH PHOTOSENSITIVE ELEMENT

Figure 1:
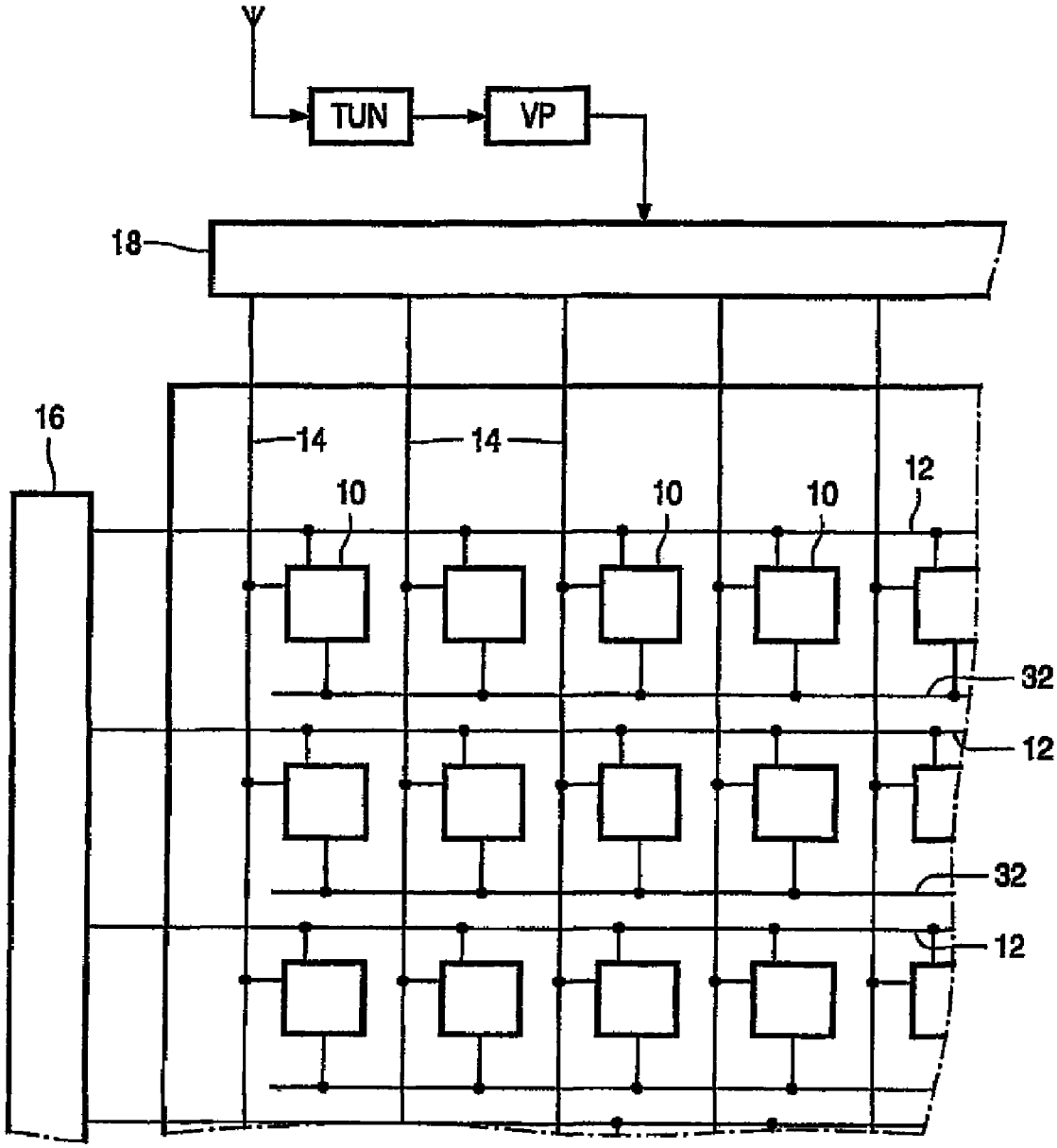
FIG. 1 Prior Art

The invention is related to a matrix display device comprising on a substrate an array of addressable pixels each having a display element and a control circuit for controlling the operation of the display element, the control circuit including a charge storage capacitor and a photosensitive device coupled to the storage capacitor for regulating charge stored on the storage capacitor in accordance with light falling on the photosensitive device, a driving element for driving the display element, a control terminal of the driving element being connected to said storage capacitor, and an addressing element for applying a data signal to the driving element.

The invention further relates to a display apparatus.

WO0199190 discloses a matrix display of the above-indicated type. The inclusion of the photosensitive device improves the uniformity of the display and compensates for aging effects of the display device. The photosensitive device is a phototransistor having a gate terminal, which is attached to the anode of the display element, here a so-called organic electroluminescent display element (OLED), in particular a polymer electroluminescent element (PLED). Ideally, for an n-type phototransistor the voltage of this connection point lies between the PLED cathode voltage (more negative) and the power voltage (more positive) to which an input terminal of the driving element is connected. The phototransistor is not driven to be conductive and therefore it acts as a photodiode responding almost linearly to the incident light.

In practice however, as the gate voltage moves with the PLED light output (PLED voltage changes with light output) there are situations where the voltage of the gate is not optimal and leakage in the photodiode—not due to the photocurrent—is increased. As a consequence the store point is discharged too quickly and the light level in the pixel is wrong.

It is an object of the invention to provide a matrix display device, which has an improved performance of the photosensitive element. To this end the display device according to the invention is characterized in that the control circuit is provided with means for independent voltage control of a control terminal of the photosensitive device. The inventors have realized that in this way the gate voltage of the photosensitive element may be freely chosen and is no longer limited to voltages available inside the pixel circuit. The biasing of the phototransistor then is more efficient. The phototransistor is always set into the region with smaller 'dark' leakage.

Furthermore, the invention has the advantage that duty-cycle techniques for motion compensation can be applied for moving images. By switching the phototransistor on (i.e. by providing a voltage of opposite polarity to turn it into a conducting TFT switch), the gate voltage of the driving transistor is set to the power line voltage. This turns the drive TFT off, and no current flows through the PLED. In this way we can prematurely stop the light output. In still images this is not required and the full benefit of the uniformity compensation of the pixel circuit can be achieved.

Further the phototransistor can be a p-type semiconductor. Then the control circuit is fully p-type only and a PMOS process for the manufacturing of the display device can be used. This is a cheaper process, as it saves typically 3 additional process masks as compared to the conventional mixed NMOS and PMOS process. In an alternative embodiment, the phototransistor can be an n-type semiconductor and the control circuit is fully n-type only and an NMOS process for the manufacturing of the display device can be used. This is also a cheaper process, as it saves typically 3 additional process masks as compared to the conventional mixed NMOS and PMOS process.

The dependent claims describe advantageous embodiments of the invention.

These and other objects of the invention will be apparent from and elucidated with reference to the embodiments described hereinafter.

Figure 2:
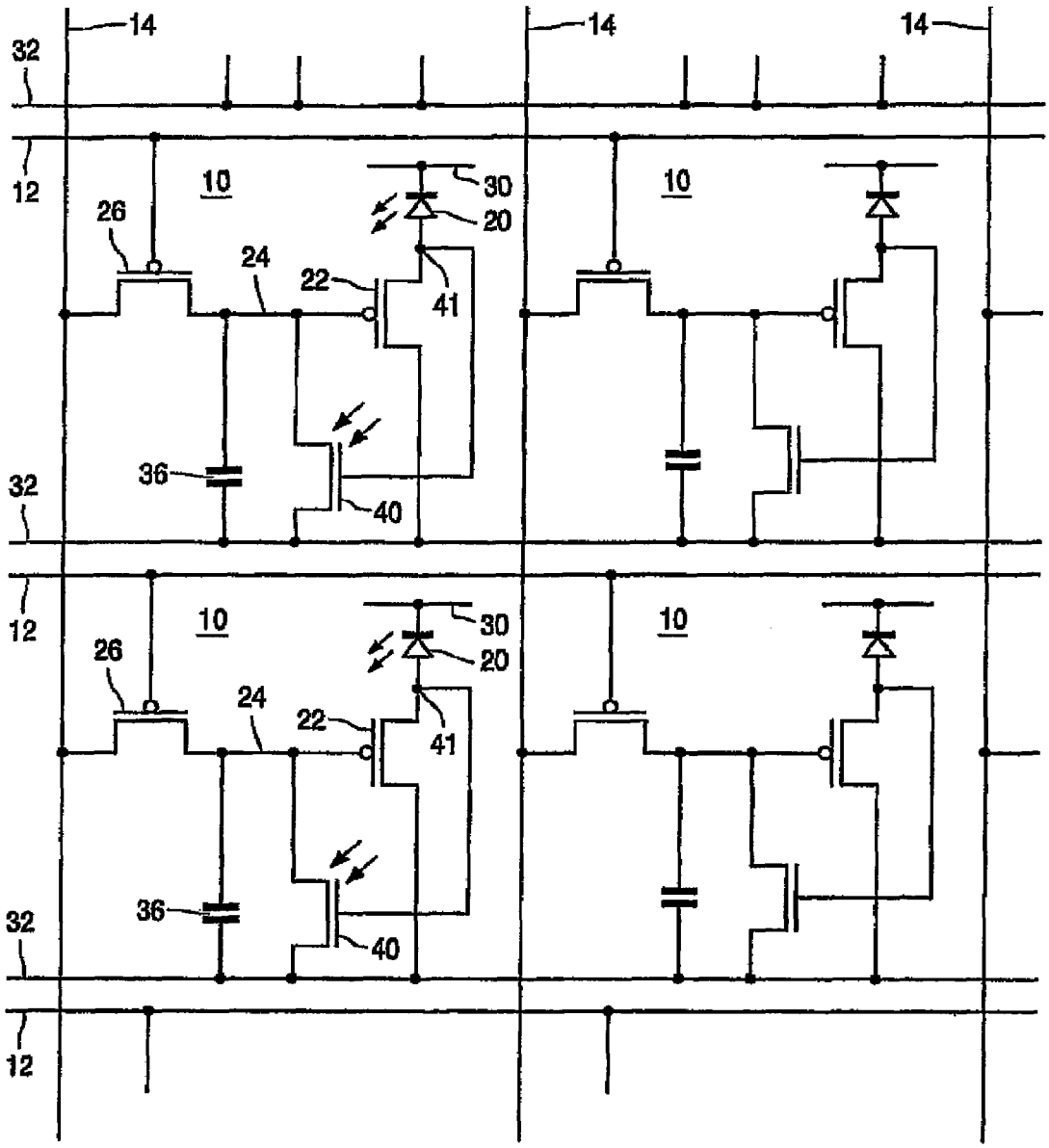
FIG. 2 Prior Art
Figure 3A:
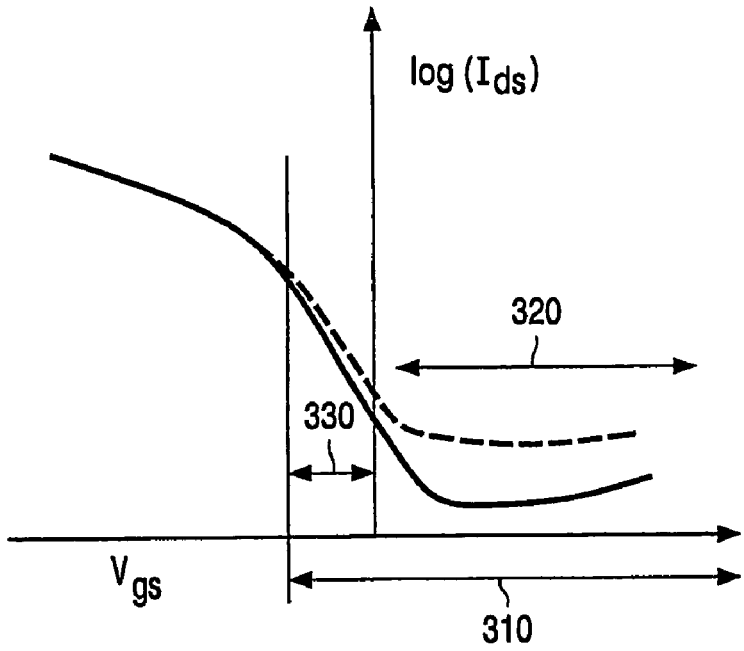
Figure 4:
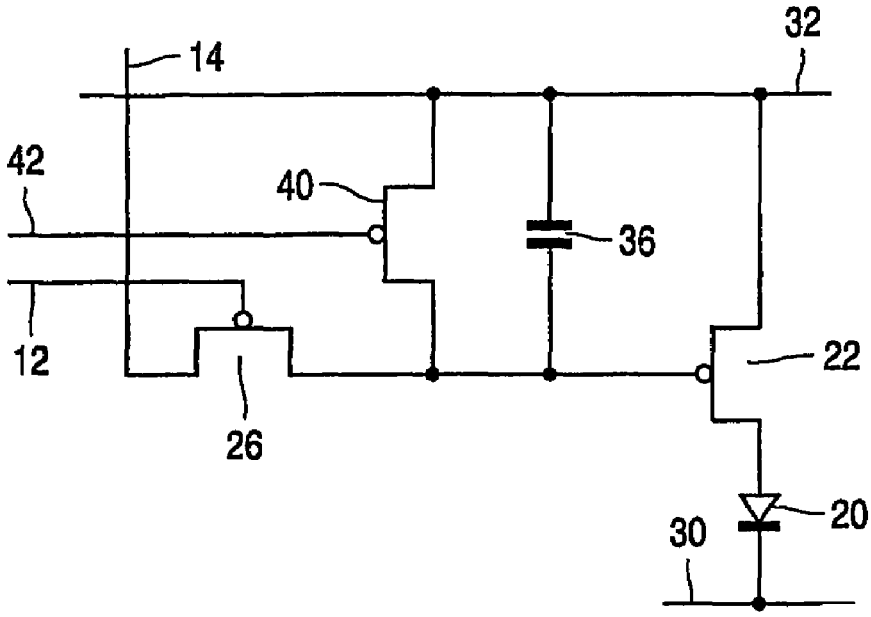
Figure 5:
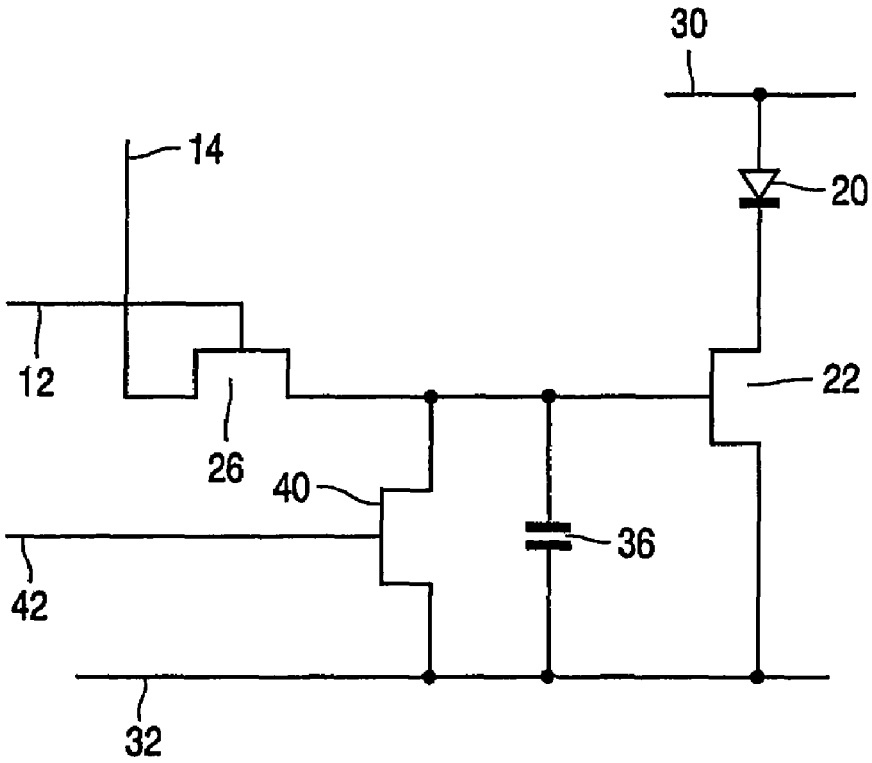
Figure 6:
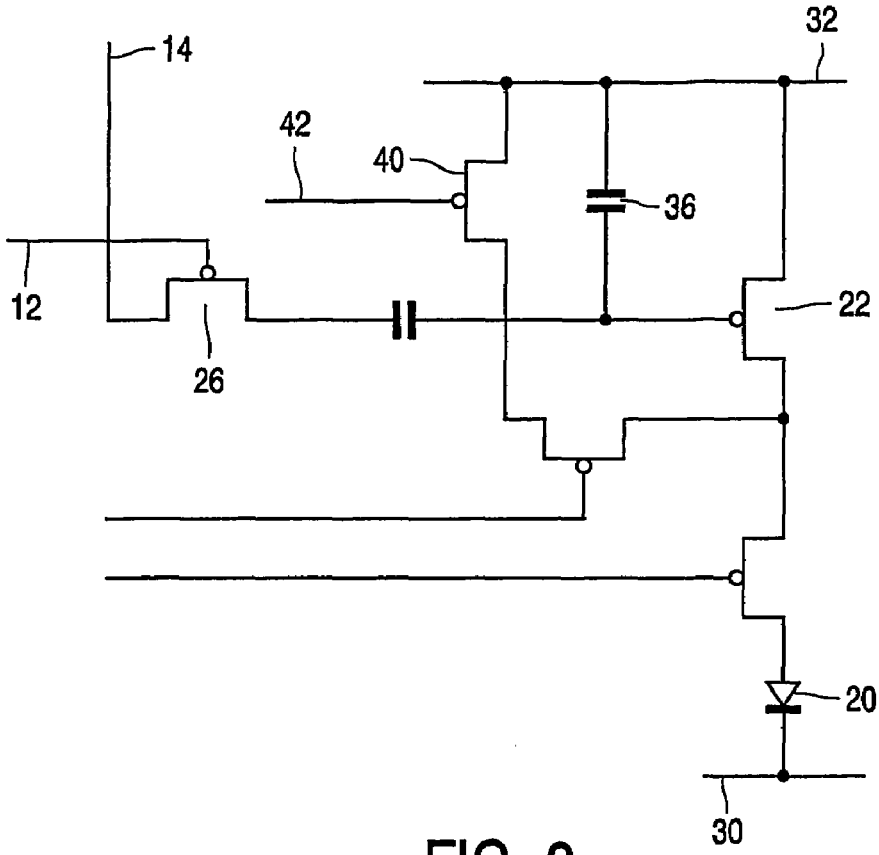
Figure 7:
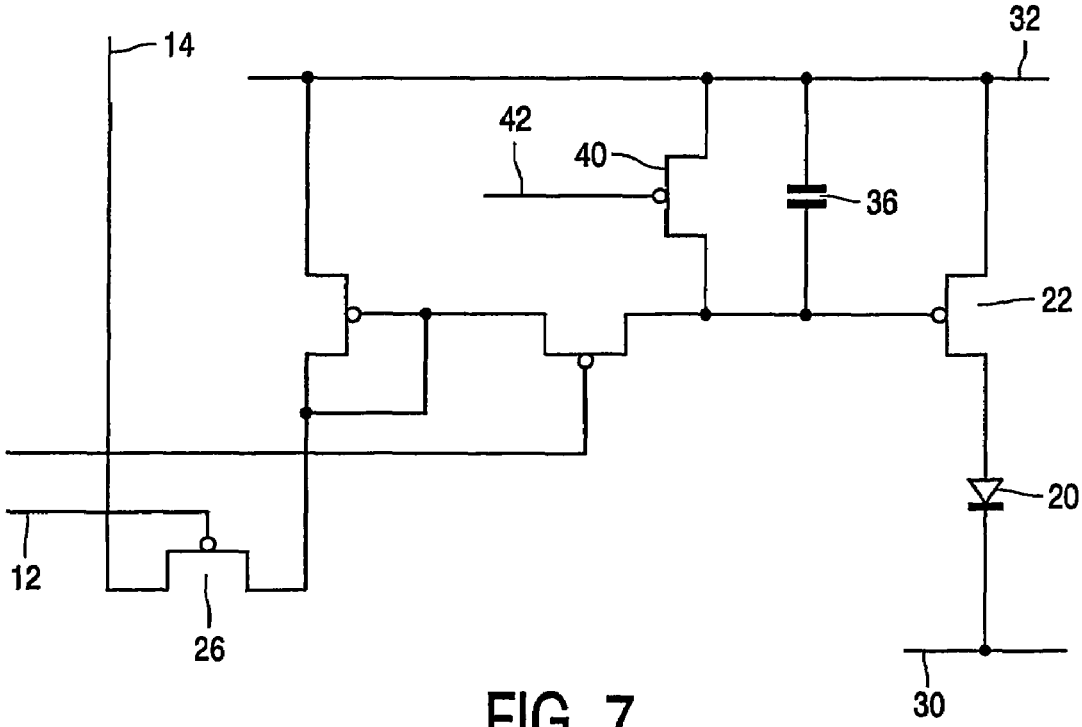
Figure 8A:
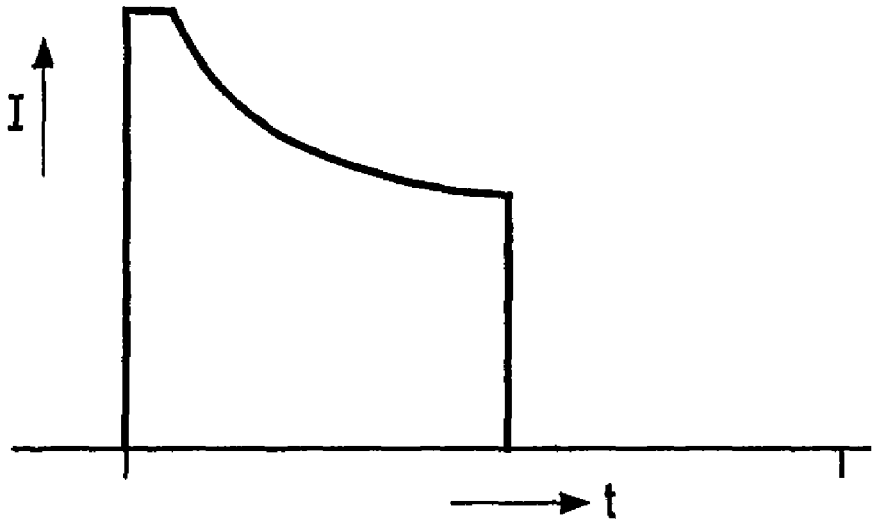
Figure 8B:
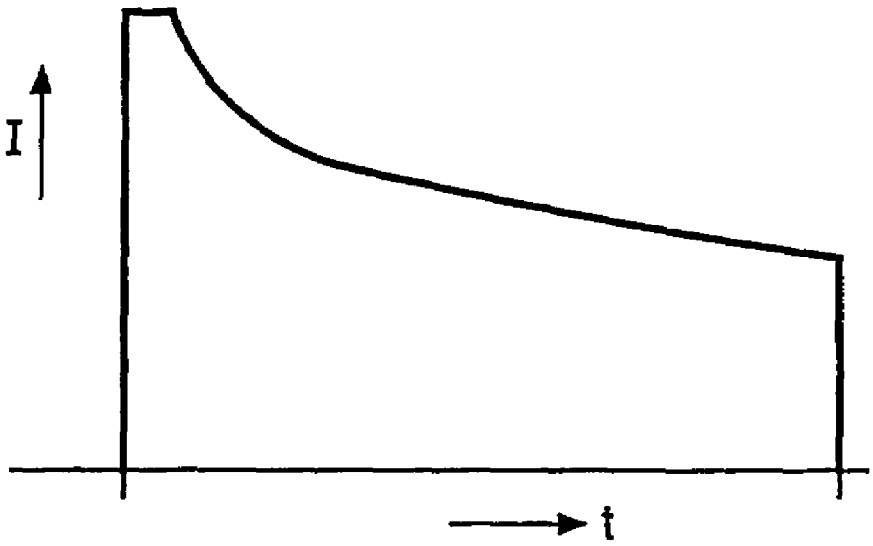

In the drawings:

FIG. 1 shows a conventional active matrix electroluminescent display device, FIG. 2 illustrates a few, typical, pixels in the circuit of the conventional display device, FIGS. 3A and B show the operation ranges of p-type and n-type phototransistors, respectively, FIG. 4 shows an embodiment of a control circuit for the display device according to the invention, FIG. 5 shows another embodiment of a control circuit for the display device according to the invention, whereby all the TFTs and phototransistors are n-type, FIG. 6 shows another embodiment of a control circuit for the display device according to the invention, FIG. 7 shows still another embodiment of a control circuit for the display device according to the invention, and FIGS. 8A and 8B show the light output of the display device according to the invention as a function of frame time in case of moving and still images, respectively.

The figures are not drawn to scale. In the figures, like reference numerals generally refer to like parts.

Referring to FIG. 1, the conventional active matrix electroluminescent display device comprises a panel having a row and column matrix array of regularly-spaced pixels, denoted by the blocks 10, each comprising an electroluminescent display element and an associated driving device controlling the current through the display element, and which are located at the intersections between crossings sets of row (selection) and column (data) address conductors, or lines, 12 and 14. Only a few pixels are shown here for simplicity. The pixels 10 are addressed via the set of address conductors by a peripheral drive circuit comprising a row, selection, driver circuit 16 and a column, data, driver circuit 18 connected to the ends of the respective conductor sets.

Each row of pixels is addressed in turn in a frame period by means of a selection signal applied by the circuit 16 to the relevant row conductor 12 so as to load the pixels of the row with respective data signals, determining their individual display outputs in a frame period following the address period, according to the respective data signals supplied in parallel by the circuit 18 to the column conductors. As each row is addressed, the data signals are supplied by the circuit 18 in appropriate synchronization.

The matrix display device is applied in a display apparatus, which further comprises a data driver circuit 18 for applying the data signal to a data terminal of the addressing switch element 26, and a selection driver circuit 16 for applying a selection signal to said selection line 12. A video signal is received via an antenna by a tuner device TUN that delivers the signal to a video processing circuit VP. The video processing circuit delivers a processed video signal to the data driver circuit 18.

FIG. 2 illustrates the circuit of a few, typical, pixels. Each pixel 10 includes a light emitting organic electroluminescent display element 20, represented here as a diode element (LED), and comprising a pair of electrodes between which one or more active layers of organic electroluminescent light-emitting material is sandwiched. In this particular embodiment the material comprises a polymer LED material, although other organic electroluminescent materials, such as low molecular weight materials, could be used. The display elements are carried, together with the associated active matrix circuitry, on the surface of an insulating substrate. The substrate is of transparent material, for example glass, and the electrodes of the individual display elements 20 closest to the substrate consist of a transparent conductive material such as ITO so that light generated by the electroluminescent layer is transmitted through these electrodes and the substrate so as to be visible to a viewer at the other side of the substrate.

Each pixel 10 includes a driving device in the form of a low temperature polysilicon TFT 22, here of p-type conductivity, which is responsible for controlling the current through, and hence operation of, the display element 20 on the basis of a data signal voltage applied to the pixel. A data signal voltage for a pixel is supplied via a column conductor 14 which is shared between a respective column of pixels. The column conductor 14 is coupled to the gate of the current-controlling drive TFT 22 through an address TFT 26, also of p-type. The gates for the address TFTs 26 of a row of pixels are all connected to a common row conductor 12.

Each row of pixels 10 also shares a common voltage supply line 30 held at predetermined potential, and normally provided as continuous electrode common to all pixels, and respective common current line 32. The display element 20 and the driving TFT 22 are connected in series between the voltage supply line 30 and the common current line 32 which acts as current source for the current flowing through the display element 20. The line 30, for example, may be at ground potential and the line 32 at a positive potential around, e.g. 12V with respect to the supply line 30. The current through the display element 20 is regulated by the drive TFT 22 and is a function of the gate voltage on the TFT 22, which is dependent upon a stored control value determined by the data signal.

An individual row of pixels is selected and addresses by the row driver circuit 16 applying a selection pulse to its associated row conductor 12 which turns on the address TFTs 26 of the pixels and defines a respective row address period. A data signal, in this case in the form of a voltage level derived from the video information supplied at the driver circuit 18 and applied to the column conductor 14 by the driver circuit 18, is transferred by the address TFT 26 to the gate node 24 of the drive TFT 22. At the end of the row address period the address transistor 26 turns off, and the voltage on the gate node 24 is retained by a pixel storage capacitor 36 connected between the gate of the TFT 22 and the common current line 32, so as to maintain the operation of the display element during the subsequent drive period.

The voltage between the gate of the TFT 22 and the common current line 32 determines the current passing through the display element 20, the current flowing through the display element being a function of the gate-source voltage of the drive 22 (the source of the p-channel type TFT 22 being connected to the common current line 32, and the drain of the TFT 22 being connected to the display element 20). This current in turn controls the light output level (grey-scale) of the pixel.

Each row of pixels is addressed in turn in this manner in a respective row address panel so as to load the pixels of each row in sequence with their respective drive signals and set the pixels to provide desired display outputs during the subsequent drive period, corresponding approximately to a frame period, until they are next addressed.

In each pixel an opto-electronic arrangement is employed to compensate for effects of display degradation, whereby the efficiency of its operation in terms of light output level produced for a given current diminishes. Through such degradation display elements that have been driven longer and harder will exhibit reduced brightness, causing display non-uniformities. The opto-electronic arrangement counteracts these effects to an extent by controlling the integrated, total, light output from an element in a drive period accordingly. Electro-optical feedback is used to adjust the charge on the storage capacitor during the drive period by discharging at a rate dependent on the instantaneous light emission of the display element during this period. Consequently, for a given data signal value the length of time for which a display element is energized to generate light during the drive period following the address period is regulated according to the subsisting drive current/light emission level characteristic of the display element, as well as the level of the applied data signal, such that the effects of degradation, particularly with regard to display non-uniformities, are reduced and the light output from individual pixels can then be substantially as uniform as would be obtained with a non-degraded display element if required.

Referring to FIG. 2 the electro-optic discharging means in this conventional display device comprises a gated photosensitive thin film device 40, which here is in the form of another TFT whose current-carrying, source and drain, electrodes are connected across the storage capacitor 36, to the gate node 24 of the drive transistor 22 and the current line 32, and whose gate is connected to the node, 41, between the drive TFT 22 and the display element 20. In this particular embodiment, where the drive TFT 22 (and address TFT 26) comprises a p-type low temperature polysilicon MOS TFT, then the device 40 is of an opposite conductivity type, i.e. an n-type polysilicon MOS TFT.

The pixel is constructed and arranged in such a way that the gated photosensitive device 40 is exposed to light emitted by the display element in operation of the pixel. At the end of the addressing phase a voltage is set on the gate node 24 of the drive TFT 22, according to the level of the applied data signal, and the capacitor 36, charged to this voltage level, serves to maintain the gate voltage of the TFT 22, at least initially, in the subsequent drive phase. The drain junction of the photosensitive device coupled to the line 32 is reverse biased and photo-responsive, and light emitted by the display element in the drive period causes a small photocurrent to be produced in the device 40 which is approximately linearly proportional to the display element's instantaneous light output level. The effect of this photocurrent is to slowly discharge the storage capacitor 36, the amount of photocurrent, and thus the rate of discharge, being dependent on the light output level of the display element. Ideally, the gate of the TFT 40 is positively biased, with its voltage corresponding to the voltage at the node 41 and always zero or negative with respect to the line 32, and this ensures that the TFT 40 is held in its off (non conductive) state. Accordingly, the transistor 40 behaves merely as a leakage device, in the manner of a reverse biased photodiode, which causes leakage of charge on the capacitor 36. The resultant discharging of the capacitor 36 in the drive period leads to the gate-source voltage of the drive TFT 22 gradually reducing which in turn progressively lowers the current flowing through the display element 20 with the light output of the display element gradually decreasing in corresponding fashion, until the TFT 22 approaches its threshold, turn-off, level. The reduction in current flowing through the display element 20 leads to a gradual decrease in the voltage level at the node 41, although this merely ensures that the TFT 40 is continuously held off. When, eventually, the voltage on the gate node 24 drops to below the TFT's threshold voltage, the light output is terminated.

Figure 3B:
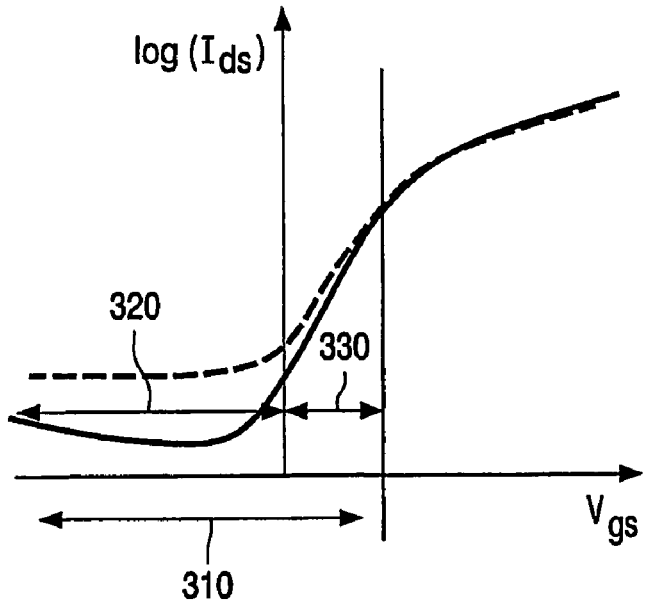

FIG. 3A shows the operation range of a p-type conductivity phototransistor, whereas FIG. 3B shows the operation range of a n-type conductivity phototransistor. Indicated is the source-drain current $I_{ds}$ on a logarithmic scale versus the applied source gate voltage $V_{gs}$. The dashed line indicated the photocurrent, whereas the continuous line indicates the dark current. Arrow 310 indicates the operating range of the phototransistor, and arrows 320 and 330 indicate the ideal region and the dangerous region for operating the phototransistor, respectively. Ideally, the phototransistor is operated in the range 320 in which the dark current is (much) smaller than the photocurrent.

In practice as the gate voltage moves with the PLED light output (PLED voltage changes with light output) there are situations where the voltage of the gate is not optimal and leakage in the photodiode—not due to the photocurrent—is increased, i.e. the region indicated with arrow 330. For example, in the case of a n-type phototransistor in operation the voltage at node 41 may be as high as 8V, whilst the control terminal of the drive TFT may be typically at around 4V. As a consequence the store point 24 is discharged too quickly and the light level in the pixel is wrong.

FIG. 4 shows the control circuit for the display device according to the invention. The gate of the phototransistor 40 is connected to a second row line 42, which is set to a separate voltage. In this way the gate voltage of the phototransistor can now freely be chosen and is no longer limited to voltages available inside the control circuit. Now, a more efficient and flexible biasing of the phototransistor is possible, so that the phototransistor is always operated in the ideal range with a low dark current.

A further advantage is that the phototransistor can be of p-type conductivity, as a consequence of which the circuit becomes fully p-type only and a single PMOS process can be used for the manufacturing of the display device. Compared to the conventional mixed NMOS/PMOS process this saves typically three additional process masks, making the process more simple and the product cheaper. In this case of a p-type phototransistor, the phototransistor can be made to be operated in the ideal range with a low dark current, by for example ensuring that the gate source voltage is in all situations above 0V.

FIG. 5 shows another embodiment of a control circuit for the display device according to the invention, whereby all the TFTs and phototransistors are n-type. As now the drive transistor 22 is n-type, it is connected to the opposite terminal of the display element. The gate of the phototransistor 40 is again connected to a second row line 42, which is set to a separate voltage. In this way the gate voltage of the phototransistor can now freely be chosen and is no longer limited to voltages available inside the control circuit. Now, a more efficient and flexible biasing of the phototransistor is possible, so that the phototransistor is always operated in the ideal range with a low dark current, by for example ensuring that the gate source voltage is in all situations below 0V. Now the circuit becomes fully n-type only and a single NMOS process can be used for the manufacturing of the display device. Again, compared to the conventional mixed NMOS/PMOS process this saves typically three additional process masks, making the process more simple and the product cheaper.

FIG. 6 shows yet another embodiment of a control circuit for the display device according to the invention, and is based upon a prior art circuit, described in U.S. Pat. No. 6,229,506, designed to compensate for variations in the threshold voltage of the drive transistor. Here also, this circuit has been improved by incorporating a p-type phototransistor. The gate of the phototransistor 40 is again connected to a second row line 42, which is set to a separate voltage. In this way the gate voltage of the phototransistor can now freely be chosen and is no longer limited to voltages available inside the control circuit. Now, a more efficient and flexible biasing of the phototransistor is possible, so that the phototransistor is always operated in the ideal range with a low dark current, by for example ensuring that the gate source voltage is in all situations above 0V. This circuit again has the advantage of being fully p-type. It will be appreciated that a similar modification of other prior art data voltage addressed pixel circuits can be carried out within the scope of the present invention.

FIG. 7 shows still another embodiment of a control circuit for the display device according to the invention, and is based upon a prior art circuit, described by S. J Bae et al. in the Proceedings of the International Display Research Conference 2000, p. 358-361 (2000). This is an example of a current mirror pixel circuit, of which there are many variants and is illustrated here again as the circuit has the advantage of being fully p-type.

Current mirror circuits are designed to compensate for variations in the threshold voltage and mobility of the drive transistor. In contrast to the previous embodiments, the data signal is here in the form of a current. During the addressing period, the current mirror ensures that the data current is mirrored onto the drive TFT, whereby the appropriate voltage is present at its control terminal 24, and stored on capacitor 36. After addressing, the drive TFT, and storage capacitor are isolated from the surroundings by a second addressing TFT. Here also, the current mirror circuit has been improved by incorporating a p-type phototransistor. The gate of the phototransistor 40 is again connected to a second row line 42, which is set to a separate voltage. In this way the gate voltage of the phototransistor can now freely be chosen and is no longer limited to voltages available inside the control circuit. Now, a more efficient and flexible biasing of the phototransistor is possible, so that the phototransistor is always operated in the ideal range with a low dark current, by for example ensuring that the gate source voltage is in all situations above 0V. It will be appreciated that a similar modification of other current mirror pixel circuits can be carried out within the scope of the present invention.

In the above embodiments, it is sufficient that the second row line 42, connected to the gate of the phototransistor 40, is a single common terminal for the entire display.

The circuits according to the invention allows duty-cycle techniques to be applied for motion compensation of moving images. FIG. 8A shows the light output I of the device as a function of frame time t in the case of moving images. As shown in FIG. 8A by switching the phototransistor on (i.e. providing a voltage of opposite polarity to turn it into a conductive TFT switch), the gate voltage of the driving transistor is set to the power line voltage. This turns the drive TFT off and no current flows through the PLED. In this way the light output is prematurely stopped.

In the case of still images, shown in FIG. 8B for the same parameters I and t, this is not required and the full benefit of the uniformity of the pixel circuit can be achieved. Hence the circuit according to the invention enables the use of duty-cycle techniques for motion blur compensation. In conventional displays the display of video images leads to sample and hold artifacts that give blurred images.

In the duty-cycle embodiments, it is preferred that the control circuit is designed such that the second row (selection) line 42, connected to the gate of the phototransistor 40, is individually addressable for each row of the display. In this case, a more natural scanning reset of the display is achieved.

In an alternative embodiment, the second row line could be common over a subset of the rows of the display, for example a block of rows situated adjacent to each other.

A further aspect of the invention relates to a display apparatus, comprising a matrix display device according to the invention, a data driver circuit 18 for applying said data signal to a data terminal of the addressing switch element 26; and a selection driver circuit 16 for applying a selection signal to said selection line 12. Preferably, the independent voltage control means 42 comprise duty cycle control means.

In summary, the invention concerns a matrix display device that comprises an array of addressable pixels 10 each having a display element 20 and a control circuit for controlling the operation of the display element. The control circuit includes a charge storage capacitor 36 and a photosensitive device 40 coupled to the storage capacitor for regulating charge stored on the storage capacitor 36 in accordance with light falling on the photosensitive device 40.

The control circuit further comprises means for independent voltage control 42 of a gate terminal of the photosensitive device 40, preferably a phototransistor. In this way a more efficient and flexible biasing of the phototransistor is possible.

The preferably means comprise a second row line 42 being connected to the gate terminal of the photosensitive device 40. This additional line allows also the use of transistors of the same polarity (p-type only or n-type only) for this type of pixel circuit, saving additional process masks (and costs). In addition, it becomes possible to use the phototransistor as a TFT switch. This dual function phototransistor/TFT switch) enables the pixel circuit to provide additional features; for example duty-cycle techniques for motion blur compensation.

The invention is also applicable to other display elements, such as elements operating on the electroluminescent principle and the field emission principle.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

The invention claimed is:

1. A control circuit for controlling a display element of a pixel in a pixel array, the control circuit comprising:

a drive transistor for driving the display element;

an address transistor for sending a data signal to the drive transistor, a gate of the address transistor being connected to a first selection line;

a capacitor connected to a gate of the drive transistor; and a photosensitive transistor coupled to the capacitor for regulating a charge stored on the capacitor in accordance with light emitted from the display element, a gate of the photosensitive transistor being connected to a second selection line for providing independent voltage control.

2. The control circuit according to claim 1, wherein each of the drive transistor, the address transistor and the photosensitive transistor comprises a thin film transistor.

3. The control circuit according to claim 1, wherein each of the drive transistor, the address transistor and the photosensitive transistor comprises a p-type transistor.

4. The control circuit according to claim 1, wherein each of the drive transistor, the address transistor and the photosensitive transistor comprises an n-type transistor.

5. The control circuit according to claim 1, wherein the first selection line comprises a first row line.

6. The control circuit according to claim 5, wherein the second selection line, comprises a second row line set to a separate voltage.

7. The control circuit according to claim 1, wherein the second selection line is individually addressable.

8. The control circuit according to claim 1, wherein the second selection line is formed by a single common terminal.

9. A control circuit for controlling a display element of a pixel in a pixel array, the control circuit comprising:

a first transistor for driving the display element, the first transistor being connected in series between a common current line and a common voltage supply line of the pixel array;

a second transistor for applying a data signal to the drive transistor, a gate of the second transistor being connected to a row selection line;

a capacitor connected to a gate of the first transistor; and a third transistor coupled to the capacitor to regulate a charge stored on the capacitor in accordance with light received by the third transistor from the display element, a gate of the third transistor being connected to a separate source voltage.

10. The matrix display device according to claim 9, wherein the display element comprises an Organic Light Emitting Diode.

11. A display apparatus, comprising:

a matrix display device as claimed in claim 1, a data driver circuit for applying said data signal to a data terminal of the addressing element; and a selection driver circuit for applying a selection signal to said second selection line.

12. The display apparatus according to claim 11, wherein said independent voltage control means comprise duty cycle control means.

* * * * *